US006178681B1

(12) United States Patent
Caloia et al.

(10) Patent No.: US 6,178,681 B1
(45) Date of Patent: Jan. 30, 2001

(54) DEVICE TAG FOR DISPLAY OF ELECTRICAL DEVICES

(75) Inventors: Lisa Cookie Caloia, Solvay; Timothy Kiggins; Frederick Kandel, both of Syracuse, all of NY (US)

(73) Assignee: Pass & Seymour, Inc., Syracuse, NY (US)

( * ) Notice: Under 35 U.S.C. 154(b), the term of this patent shall be extended for 0 days.

(21) Appl. No.: 09/211,409

(22) Filed: Dec. 15, 1998

(51) Int. Cl.[7] ..... G09F 3/10
(52) U.S. Cl. ..... 40/673; 40/662; 174/66
(58) Field of Search ..... 40/673, 631, 662, 40/663; 174/66, 67; 361/118, 119

(56) References Cited

U.S. PATENT DOCUMENTS

| | | | | |
|---|---|---|---|---|
| D. 74,031 | | 12/1927 | Stanton . | |
| D. 253,389 | | 11/1979 | South, Jr. . | |
| D. 294,485 | | 3/1988 | Johansson . | |
| D. 301,722 | | 6/1989 | Sachs . | |
| D. 314,984 | | 2/1991 | Haas . | |
| D. 334,980 | | 4/1993 | Skarin . | |
| D. 336,930 | | 6/1993 | Mori et al. . | |
| D. 338,688 | | 8/1993 | Mori et al. . | |
| 1,930,610 | * | 10/1933 | Despard . | |
| 2,515,820 | * | 7/1950 | Clark . | |
| 3,281,758 | * | 10/1966 | Appleton . | |
| 3,953,933 | * | 5/1976 | Goldstein . | |
| 3,963,124 | | 6/1976 | Banks . | |
| 3,993,814 | | 11/1976 | Cavender . | |
| 4,479,317 | * | 10/1984 | Hanna | 40/638 X |
| 4,868,027 | | 9/1989 | Hunkeler et al. . | |
| 5,073,681 | * | 12/1991 | Hubben et al. . | |
| 5,085,906 | | 2/1992 | Ast et al. . | |
| 5,153,816 | * | 10/1992 | Griffin . | |
| 5,343,647 | | 9/1994 | Bulka . | |
| 5,379,538 | | 1/1995 | Osborne . | |
| 5,449,201 | | 9/1995 | Miller et al. . | |
| 5,594,206 | * | 1/1997 | Klas et al. . | |
| 5,645,300 | | 7/1997 | Hill . | |
| 5,675,125 | * | 10/1997 | Hollonger . | |
| 5,693,911 | * | 12/1997 | Sydow | 40/638 X |
| 5,723,817 | * | 3/1998 | Arenas et al. . | |
| 5,769,653 | * | 6/1998 | Osterbrock et al. | 40/638 X |

* cited by examiner

*Primary Examiner*—Terry Lee Melius
*Assistant Examiner*—William L. Miller
(74) *Attorney, Agent, or Firm*—Wall Marjama & Bilinski

(57) ABSTRACT

A merchandising tag for use on displayed electrical devices is disclosed. The tag includes an aperture which may accept an existing screw of the electrical device, to trap the tag between the screw head and the device. The aperture may be preformed or may be a die-cut perforation. The tag includes identification indicia usable for merchandising the displayed device. The tag may be a single stiff layer, or may include a first paper layer attached to a second stiff plastic layer. The first paper layer would include the indicia and may advantageously be an attention grabbing color such as a fluorescent color. In either embodiment, the tag is preferably stiff and bend-resistant enough to extend from the device in a secure manner, without sagging or folding over. The tag may further include a shape having a top section carrying the indicia and a bottom section carrying the aperture, wherein the top section tapers towards the bottom section such that the tag can be positioned at several angles relative to the device. In one embodiment, the tag may take the shape of a light bulb. In other embodiments, the tag may take the shape of a lightening bolt or a paint splat. A method for merchandising an electrical device using the tag is also disclosed.

17 Claims, 6 Drawing Sheets

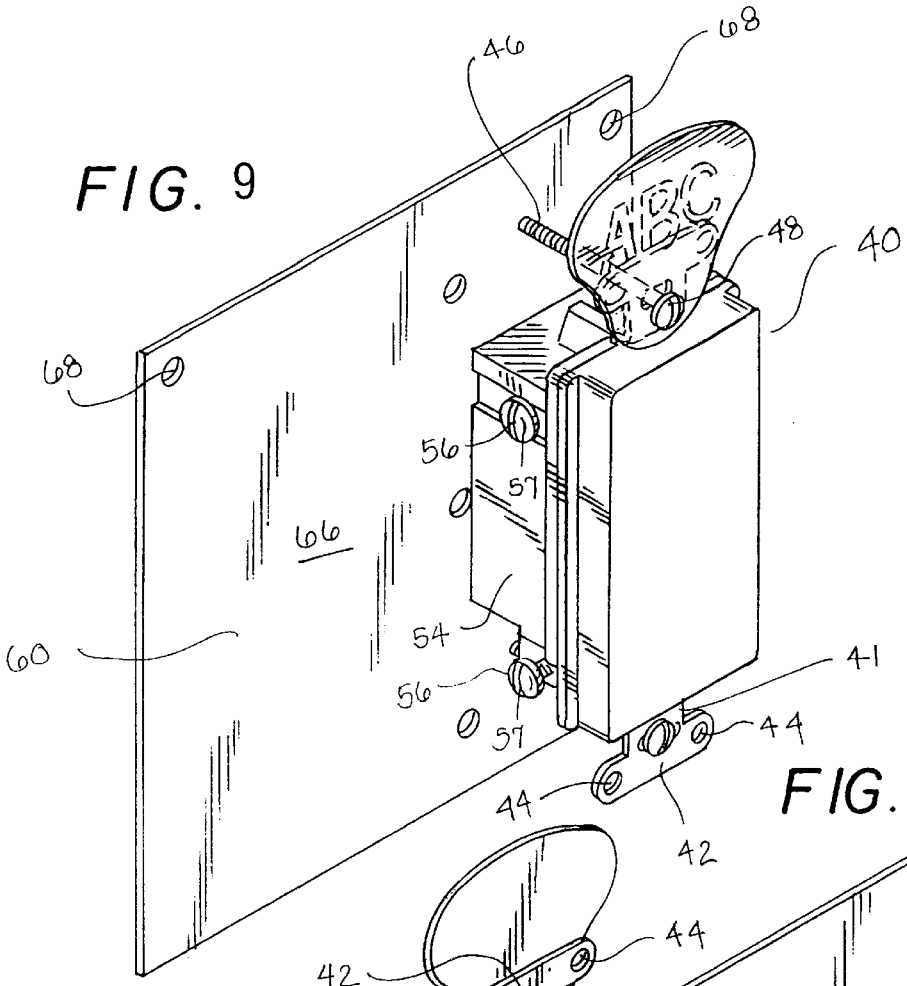
FIG. 9
FIG. 10
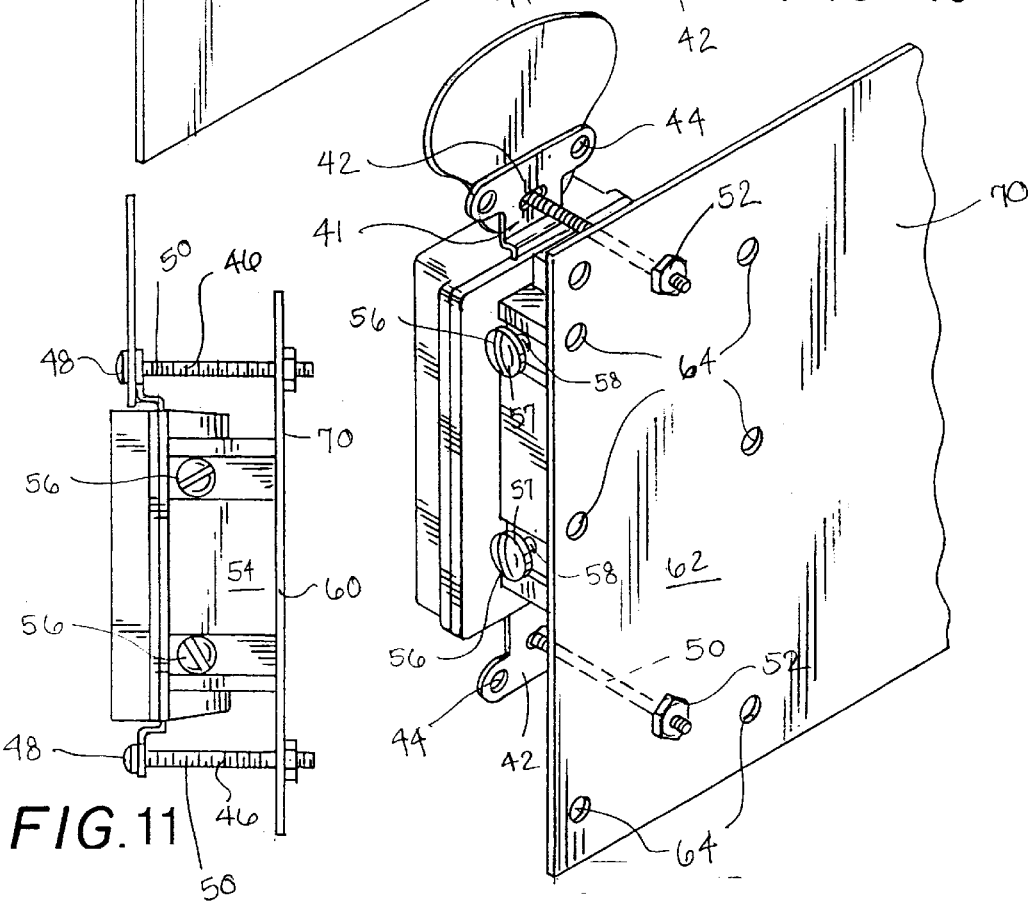
FIG. 11

DEVICE TAG FOR DISPLAY OF ELECTRICAL DEVICES

FIELD OF THE INVENTION

The present invention relates to tags for merchandising displays, and more particularly to a tag having a hole and attached to an electrical device by an existing screw on the device.

BACKGROUND OF THE INVENTION

Labels have been used in the prior art most frequently to convey the price of an object to a consumer, but may also contain other information including inventory control numbers and/or the retailer's name. The labels may additionally relate information by their color (for example, a "red tag" sale). Labels of this type include adhesion labels, tag labels, and dumbbell labels.

Adhesion labels are useful for labeling flat items, but are not desirable if the label must be placed on the end product and then be scraped off the product by the purchaser. In addition, it is difficult to use an adhesion label for a merchandising display to effectively gain the attention of a potential customer because the adhesion label can only be supported by the product itself. An adhesion label is typically not stiff enough to extend above or below the product, and even if it is, the exposed sticky backside would become a magnet for dust and debris, ruining the aesthetic value of the display.

Conventional tag labels include a hole, usually punched near one edge, through which a string is threaded and knotted to form a continuous loop. Tag labels are typically attached to objects having an appendage or some other type of hole through which the string can pass. While conventional tag labels are typically stiffer than the above-described adhesion labels, the method for connecting them to objects has prohibited them from being extremely useful in merchandising displays, since the tag is allowed to flop around with the slightest breeze, making the tag difficult to read in a display.

Dumbbell labels are adhesive-backed dumbbell shaped labels which can be attached to an item and secured thereto by folding upon itself. These labels are difficult to properly align, and there is no opportunity for a second try. In addition, a hole or appendage is required on the device being displayed for the dumbbell label to be properly used.

Thus, the above known labels are not adequately suited for merchandising displays. In addition, they do not take into account the special needs of merchandising electrical devices.

The prior art has shown some attempts at solving the above-described problems where electric wires are concerned, for example, U.S. Pat. Nos. D336,930, D338,688, and D344,980, show identification tags for electric wires. These tags, however, are limited in use to electrical wires, and they are designed for installer/electrician use rather than for merchandising and for gaining the attention of potential customers.

Thus, there is a need for a merchandising tag which is specifically designed for use on an electrical device, and which solves the above-described problems of the prior art.

SUMMARY OF THE INVENTION

Thus, it is an object of the present invention to provide a tag having an aperture which is stiff enough to be self-supporting above a displayed product.

It is another object of the present invention to provide a tag having a shape enabling it to be used in many locations and angles relative to a displayed product.

It is a further object of the present invention to provide a tag attractive to consumers, including bright colors and relevant information about the displayed product.

It is yet another object of the present invention to provide an electrical device which secures the tag of the present invention to the device by passing an existing screw of the device through the aperture of the tag.

It is yet a further object of the present invention to provide a method for merchandising an electrical device using the tag of the present invention.

Other objects will in part be obvious and in part appear hereinafter.

In a preferred embodiment of the present invention, an electrical display preferably would include an electrical device, a screw passing through a portion of the electrical device, and a tag having a hole, wherein the tag is secured to the electrical device by passing the screw through the hole and back into said portion of the electrical device. In one embodiment, the electrical device may be a light switch with the tag being light bulb shaped and the screw passing through the yoke of the switch. In another embodiment, the screw may pass through a backbody of the electrical device.

The tag preferably includes identifying indicia about the electrical device, and may include two layers, a first layer being a fluorescent-colored non-glossy material bearing the indicia and a second layer being a stiff self-supporting plastic material. The tag may also have an upper bulbous section where the indicia is imprinted and a lower section where the hole is located, the upper section tapering towards the lower section, so that the tag may be pivotal about the screw and relative to the electrical device.

The display may further comprise a stiff self-supporting display panel to which the electrical device is attached, the panel having an attachment area having a plurality of apertures for attaching the electrical device to the attachment area, and an informational area for receiving indicia.

The present invention also encompasses a method for displaying an electrical device comprising the steps of selecting an electrical device to display, providing identifying indicia on a tag which relates to the electrical device, providing a preformed aperture on the tag, backing out an existing screw in the electrical device, pushing a shaft of the screw through the preformed aperture on the tag, screwing the screw into place on the electrical device and, securing the tag on the electrical device between a head of the screw and the electrical device.

BRIEF DESCRIPTION OF THE DRAWINGS

FIG. 9 shows a front perspective view of the tag of FIG. 1 used in conjunction with an electrical device.

FIG. 10 shows a rear perspective view of FIG. 9.

FIG. 11 shows a side plan view of FIG. 9.

DETAILED DESCRIPTION OF THE PREFERRED EMBODIMENTS

Figure 1:
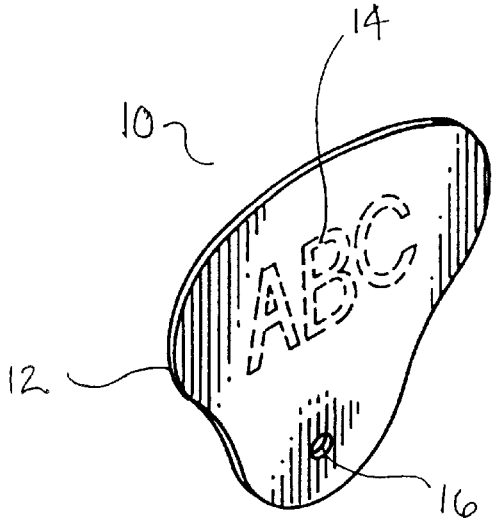
FIG. 1 shows a front perspective view of a tag according to one embodiment of the present invention.
Figure 2:
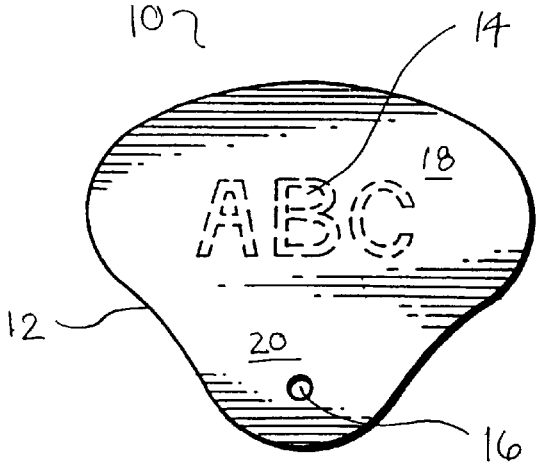
FIG. 2 shows a front plan view of the tag of FIG. 1.

FIGS. 1–4 show a first preferred embodiment of the present invention. A tag 10 comprises a generally planar member 12 onto which indicia 14 may be printed. The indicia could include information relating to the product to which it is attached. For example, if the tag is applied to a three way or four way electrical switch, the indicia 14 could read "3-WAY" or "4-WAY". In addition, separate sub-indicia, printed below the main indicia, could provide further explanations. For example, under "3-WAY", the sub-indicia could read "When one light is controlled by 2 switches" and under "4-WAY", the sub-indicia could read "When one light is controlled by 3 or more switches." Alternatively, the indicia 14 could simply read "LIGHTED" or "NEW!". Of course, any other indicia is within the scope of this invention.

The member 12 includes an aperture 16. As will be shown, the aperture 16 may accept a screw. The aperture 16 may either be preformed in the member 12, such as during the stamping process of the member 12, or may be a circular die-cut perforation, through which a circular shape may be pushed out of the member 12 to form the aperture 16. While the aperture 16 is shown as circular, it is certainly within the scope of this invention to utilize alternative shapes, although they must be able to accept the shaft of a screw.

The member 12 is shown as having a distinct shape in FIGS. 1–4. Although any shape is within the scope of this invention, it is preferred for the shape of the member 12 to include a bulbous top section 18 tapering to a bottom section 20. The bulbous section is bulbous for providing maximum area for the indicia 14. The bottom section 20 is of adequate size to maintain the aperture 16. The tapered section 20 enables the member 20 to tilt with respect to the device on which it is attached.

Figure 3A:
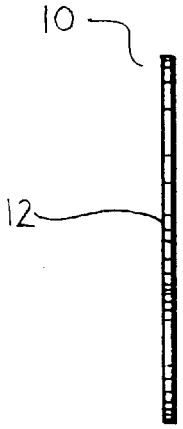
FIG. 3A shows a side view of one embodiment of the tag of FIG. 1.
Figure 4:
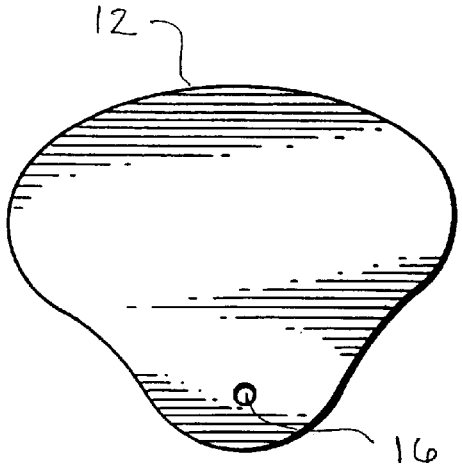
FIG. 4 shows a rear plan view of the tag of FIG. 1.
Figure 3B:
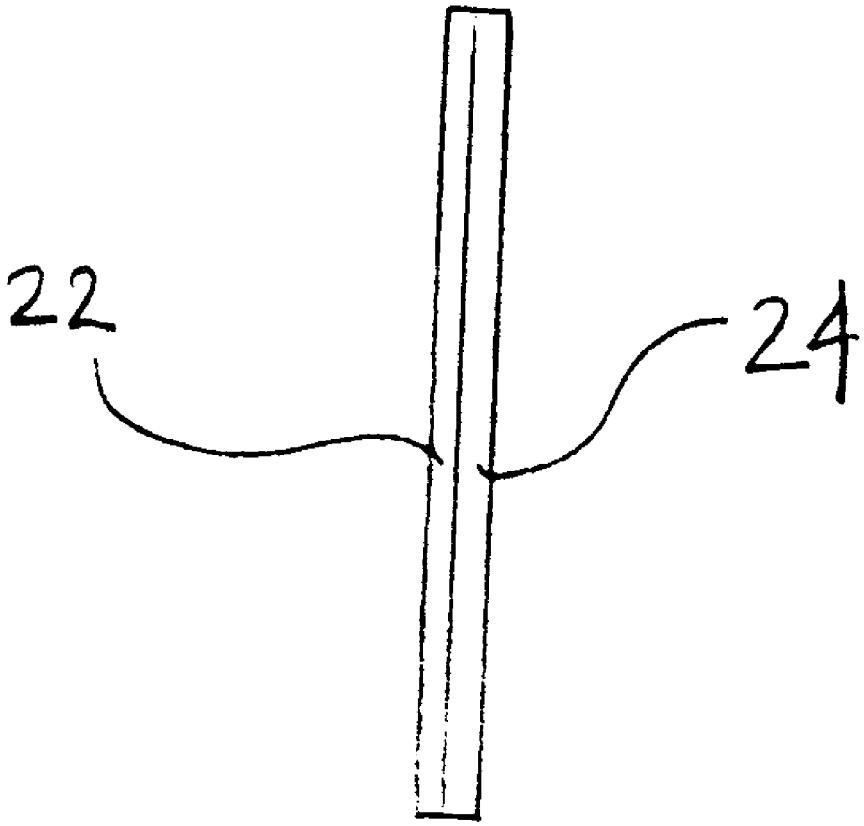
FIG. 3B shows a side plan view of another embodiment of the tag of FIG. 1.
Figure 5:
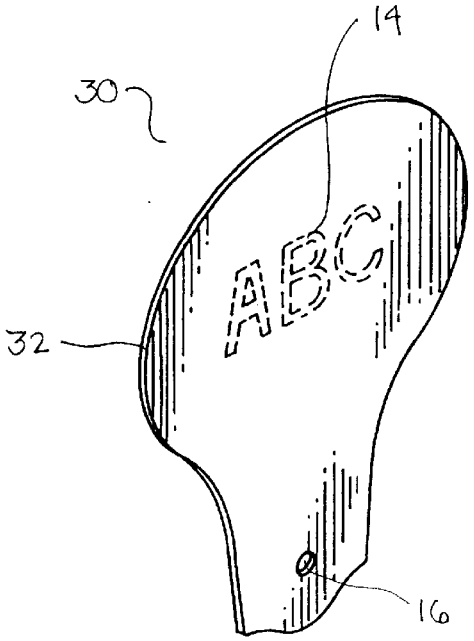
FIG. 5 shows a front perspective view of a tag according to another embodiment of the present invention.
Figure 6:
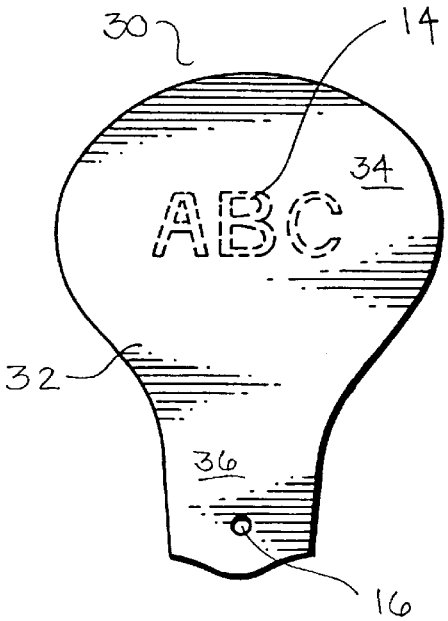
FIG. 6 shows a front plan view of the tag of FIG. 5.
Figure 7:
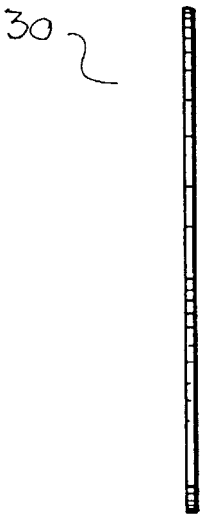
FIG. 7 shows a side plan view of the tag of FIG. 5.
Figure 8:
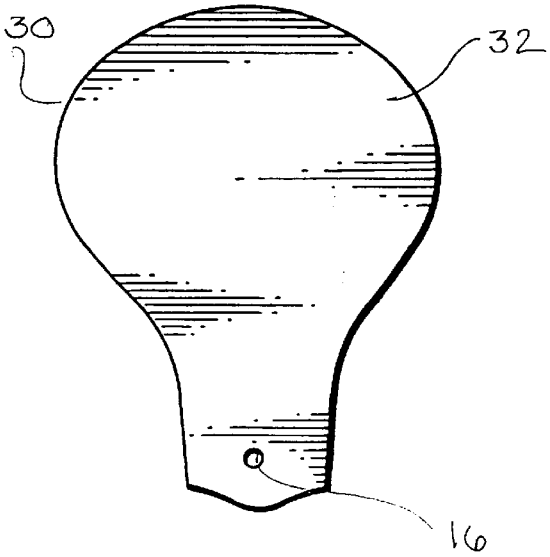
FIG. 8 shows a rear plan view of the tag of FIG. 5.
Figure 12:
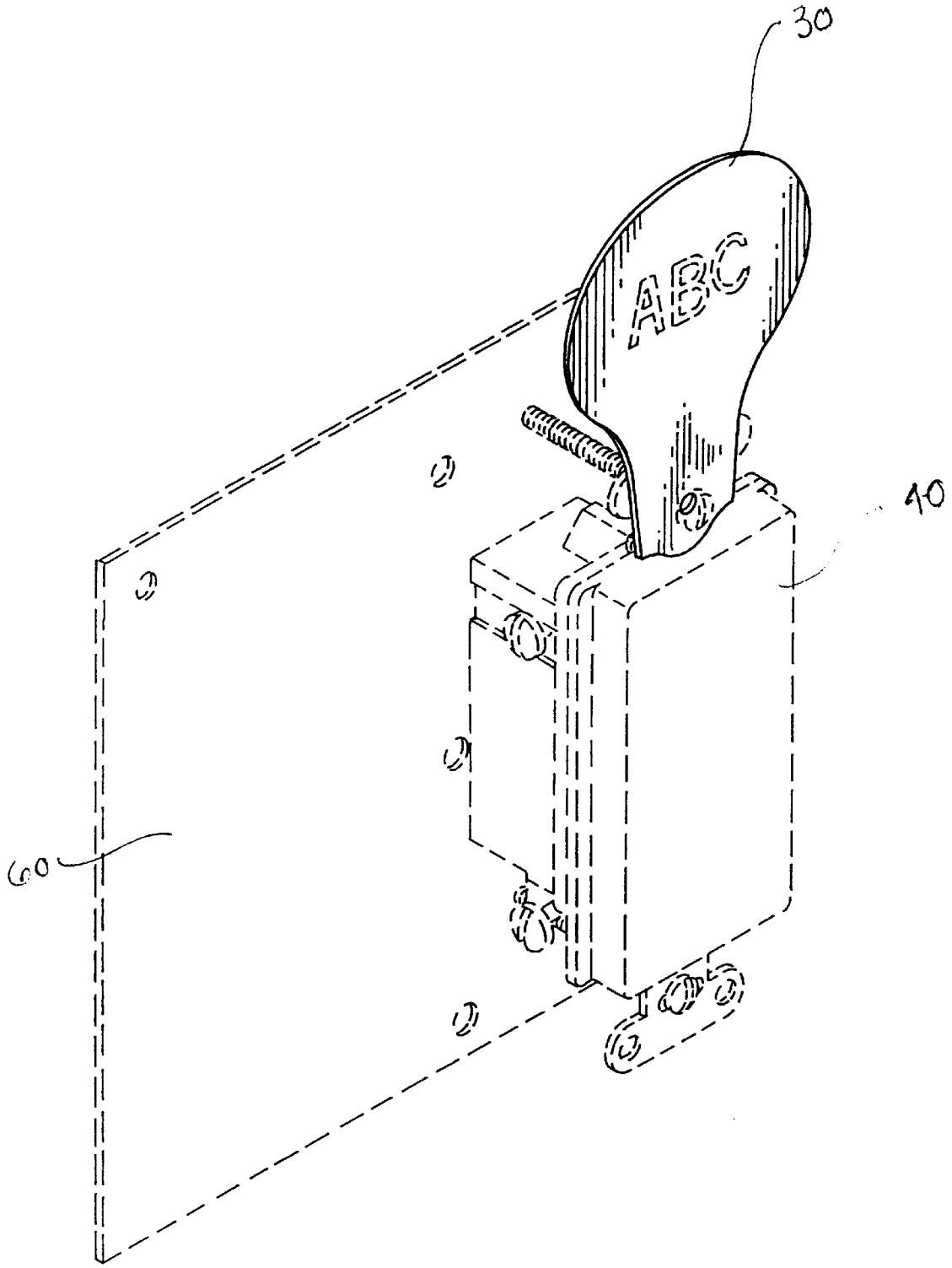
FIG. 12 shows a front perspective view of the tag of FIG. 5 used in conjunction with an electrical device, shown in phantom.

FIG. 3A shows a side view of the member 12 in which the member 12 is formed of a single layer of material. Preferably, this layer is formed of a stiff paper, cardboard, plastic, or other material stiff enough to resist bending and stand erect above a device on which the member 12 is attached. FIG. 3B shows an alternate embodiment of the member 12 formed of two separate layers of material, laminated or otherwise securely attached. A top layer 22 may be a non-glossy sheet of paper for accepting the indicia 14 and a bottom layer 24 may be a stiff plastic sheet, which provides the desired stiffness for the member 12. The non-glossy layer 22 may be fluorescent colored, such as fluorescent orange or green, which works to rapidly gain the attention of passerby's.

FIGS. 5–8 show an alternate embodiment of the present invention. A tag 30, similar to the tag 10, includes a generally planar member 32 which may bear indicia 14 and include an aperture 16. The primary difference between the tag 30 and the tag 10 is the shape. Since the tags of the present invention are suited for merchandising electrical devices, the tag 30 is shown as taking the shape of a light bulb. That is, the tag 30 includes a rounded top section 34 tapering towards a straighter bottom section 36. The rounded top section 34 preferably provides enough room for the indicia 14 and the bottom section 36 contains the aperture 16. Thus, the tag 30 is ideal for merchandising light switches.

FIGS. 9–12 show how the tags of the present invention may be utilized to merchandise electrical devices. FIG. 9 shows a front perspective view of a generic electrical device 40 mounted to a panel 60. The panel 60 may be a stiff self-supporting member attachable to a front of a box containing a plurality of the displayed device. Alternatively, the panel 60 may be slid within a track attached to a front of a store shelf. The panel 60 may even be attached to a peg board, often used in hardware stores and the like. The panel 60 is preferably separated into two areas. First area 62 is an attachment area which includes a plurality of apertures 64 designed for attaching a variety of different types of electrical devices to the panel. The second area 66 is an informational area which can include indicia regarding the displayed product, such as the name of the product, trademarks, product number, maker information, product information, and other advertising information. The panel 60 may further include apertures 68 for securing the panel 60 to a vertical surface, such as a box front or peg board, as described above. Although the electrical device 40 is shown as mounted to a panel 60, it should be understood that the electrical device 40 could be directly mounted to a box, shelf, pegboard, or in any other manner in which the electrical device 40 is to be merchandised, without affecting the scope of the invention.

The electrical device 40 shown in FIGS. 9–12 may include, but is not limited to, a rocker switch, light switch, duplex receptacle, dimmer switch, and any other wall mounted type electrical device or wall mounted covering such as a wall plate or safety cover for electrical devices. Thus, the shape of the electrical device 40 shown in FIGS. 9–12 is for illustration purposes of the type of electrical device which may take advantage of the present invention. The electrical device 40 may include a yoke 41 having mounting ears 42 with apertures 44 through which screws 46 are passed. The screws 46 include heads 48 and shafts 50. The screws 46 may be maintained on the electrical device 40 by securing bolts 52 to the ends of the shafts 50, on a rear side 70 of the panel 60. The electrical device 40 may further include a back body 54 which includes the mechanical apparatus and electrical circuitry for providing function to the device. Such a back body 54 typically includes side screws 56 to which electrical wires may be attached for providing the necessary electrical connections for the electrical device 40. Such screws 56 also include heads 57 and shafts 58.

Figure 13:
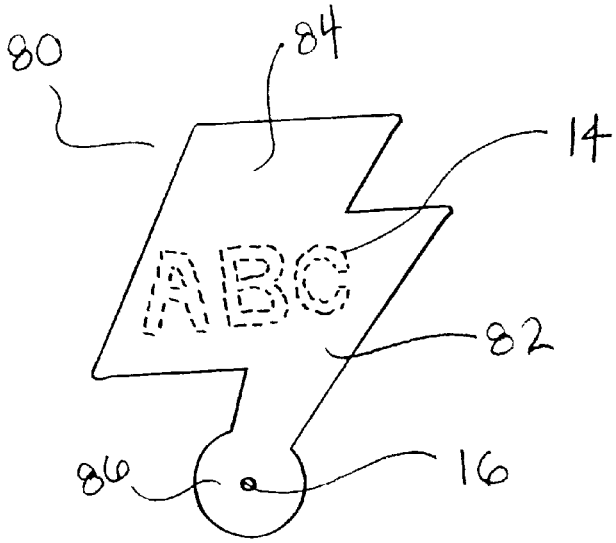
FIG. 13 shows a front plan view of a tag according to a further embodiment of the present invention.
Figure 14:
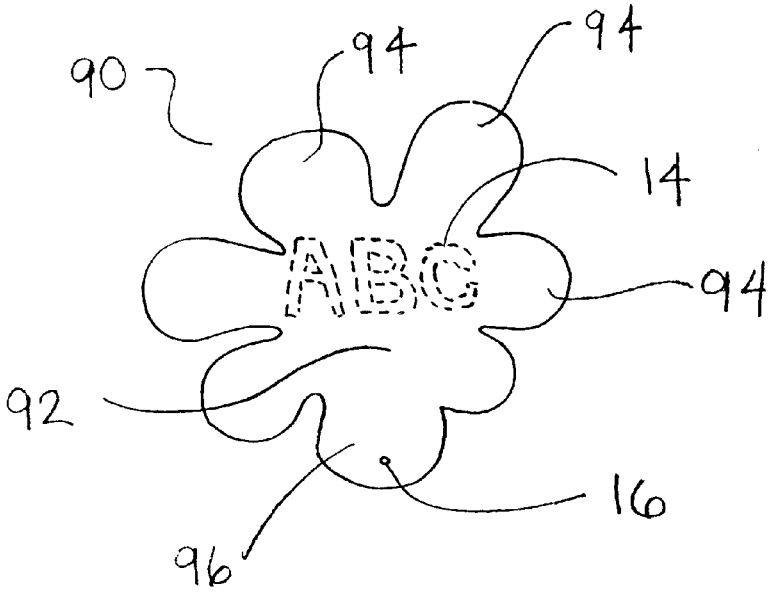
FIG. 14 shows a front plan view of a tag according to yet another embodiment of the present invention.

FIGS. 13 and 14 show alternate embodiments of the present invention. As shown in FIG. 13, a tag 80 includes a generally planar member 82 which may bear indicia 14 and include an aperture 16. The primary difference between the tag 80 and the tags 10 and 30 is the shape. Since the tags of the present invention are suited for merchandising electrical devices, the tag 80 is shown as taking the shape of a lightening bolt. That is, the tag 80 includes a sharply angled top section 84 tapering towards the aperture 16. The bottom section 86 may be rounded and concentric with the aperture 16. The top section 84 preferably provides enough room for the indicia 14, which may, by example only, recite "Protects computers, stereos . . . from surges". Thus, the tag 80 is ideal for merchandising surge protectors. As shown in FIG. 14, a tag 90 includes a generally planar member 92 which may bear indicia 14 and include an aperture 16. The primary difference between the tag 90 and the previous embodiments is the shape. The shape of the tag 90 is more of a "fun"

shape, and includes many rounded protrusions 94 to give it the look of a fanciful flower or a paint splat. A bottom section 96 includes the aperture 16. The tag 90 preferably provides enough room for indicia 14, which may be used, by example only, to denote an artistic feature of the electrical device such as color, e.g. "New—Light Almond!".

To use one of the tags 10, 30, 80, or 90 in conjunction with an electrical device 40, one need only back out one of the existing screws 46 or 56 from the device 40, pass a shaft 50 or 58 through the aperture 16 of the tag, and resecure the screw 46 or 56 to the device 40 such that the tag is trapped between the head 48 or 57 and the mounting ear 42 or back body 54, respectively. Of course, alternate types of electrical devices 40 may have screws in alternate locations which could also be used in the same manner to secure the tag to the device. If the aperture 16 is created by a die-cut perforation, the method of using the tag to merchandise an electrical device would further comprise the step of pushing the shaft of the screw through the die-cut perforation to create the aperture.

Although the tags 10, 30, 80, and 90 are ideal for use with wall mounted type electrical devices, it should be understood that the tags may find alternative uses in a variety of other fields, and need not be restricted in use to electrical devices or devices having existing screws.

Thus, it is apparent that there has been provided, in accordance with the invention, a device tag for display of electrical devices that fully satisfies the objects and advantages set forth above. While the invention has been described in conjunction with specific embodiments thereof, it is evident that many alternatives, modifications, and variations will be apparent to those skilled in the art in light of the foregoing description. Accordingly, the present invention is intended to embrace all such alternatives, modifications, and variations as fall within the spirit and broad scope of the appended claims.

What is claimed is:

1. An electrical display comprising:

an electrical device;

a screw passing through a portion of the electrical device;

a tag having a hole;

the tag having an upper bulbous section with space for printing identifying indicia about the electrical device and a lower section where the hole is located, the upper section tapering toward the lower section;

wherein the tag is secured to the electrical device by passing the screw through the hole and back into said portion of the electrical device such that the upper section of the tag extends beyond the electrical device.

2. The display of claim 1 wherein the electrical device is a light switch.

3. The display of claim 2 wherein the tag is light bulb shaped.

4. The display of claim 4 wherein the light switch includes a yoke and the screw passes through the yoke.

5. The display of claim 1 wherein the electrical device includes a backbody, the screw passing through the hole in the tag and through a side of the backbody.

6. The display of claim 1 further comprising a stiff self-supporting display panel to which the electrical device is attached, the panel having an attachment area having a plurality of apertures for attaching the electrical device to the attachment area, the panel further having an informational area for receiving indicia.

7. The display of claim 6 wherein the electrical device includes a yoke and the screw passes through the hole in the tag, through the yoke, and through one of said plurality of apertures in the attachment area of the panel.

8. The display of claim 1 wherein the tag has two layers, a first layer being a fluorescent-colored non-glossy material bearing the indicia and a second layer being a stiff self-supporting plastic material.

9. The display of claim 1, wherein the tag is pivotal about the screw and relative to the electrical device.

10. The display of claim 1 wherein the electrical device is a surge protector.

11. The display of claim 10 wherein the tag is lightening bolt shaped.

12. The display of claim 1 wherein the tag bears indicia regarding a color of the electrical device and the tag is generally flower shaped.

13. A method of displaying an electrical device comprising the steps of:

selecting an electrical device to display;

providing identifying indicia on a tag which relates to the electrical device;

providing a preformed aperture on the tag;

pushing a shaft of a fastener through the preformed aperture on the tag; and securing the tag on the electrical device between a head of the fastener and the electrical device such that the portion of the tag including the indicia extends beyond the electrical device.

14. The method of claim 13 further comprising the step of securing the electrical device to a display panel.

15. The method of claim 13 further comprising the step of backing out an existing screw in the electrical device wherein the step of backing out an existing screw in the electrical device comprises the step of backing out a screw from a yoke of the electrical device.

16. An electrical display comprising:

an electrical device having a yoke and a backbody;

a first screw passing through the yoke of the electrical device and a second screw screwed into the backbody of the electrical device; and a tag including identifying indicia about the electrical device, the tag further having an upper bulbous section where the indicia is imprinted, and a lower section having a hole, the upper section tapering towards the lower section;

wherein the tag is secured to the electrical device by passing one of the first screw and the second screw through the hole and back through the yoke or into the back body of the electrical device such that the upper section of the tag extends beyond the electrical device, and wherein the tag is pivotal about the screw and relative to the electrical device.

17. An electrical display comprising:

an electrical device;

a fastener passing through a portion of the electrical device;

a tag having a hole, wherein the tag is secured to the electrical device by passing the fastener through the hole and back into said portion of the electrical device;

the tag having an upper section which extends beyond the electrical device when secured to the electrical device and a lower section where the hole is located;

the upper section having space permitting an inscription to be inscribed thereon; and the tag being removable from said electrical device upon installation of the electrical device.

* * * * *